United States Patent [19]

Mazzarese

[11] Patent Number: 4,565,043

[45] Date of Patent: Jan. 21, 1986

[54] BUILDING BLOCK WITH REINFORCEMENT AND/OR POSITIONING LUGS AND RECESSES

[76] Inventor: Joseph A. Mazzarese, 6263 SW. 44th St., South Miami, Fla. 33155

[21] Appl. No.: 528,852

[22] Filed: Sep. 2, 1983

[51] Int. Cl.[4] ..... E04C 1/10

[52] U.S. Cl. ..... 52/593; 52/603

[58] Field of Search ..... 52/99, 589–595, 52/204, 286, 603, 438, 585–587

[56] References Cited

U.S. PATENT DOCUMENTS

| | | | |
|---|---|---|---|
| 1,214,964 | 2/1917 | Small | 52/587 |
| 1,385,606 | 7/1921 | Christensen | 52/240 |
| 1,444,554 | 2/1923 | Quillet | 52/585 |
| 1,557,523 | 10/1925 | Hahn | 52/587 |
| 1,757,389 | 5/1930 | Rikert | 52/124.2 |
| 2,212,184 | 8/1940 | Powell | 52/589 |
| 2,241,169 | 5/1941 | Yokes | 52/593 |
| 2,412,307 | 12/1946 | Tatsch | 52/89 |
| 3,220,141 | 11/1965 | Goss | 52/590 |
| 3,881,571 | 5/1975 | Moulton | 52/585 |
| 4,107,895 | 8/1978 | LeGrady | 52/438 |

FOREIGN PATENT DOCUMENTS

| | | | |
|---|---|---|---|
| 1084880 | 7/1954 | France | 52/204 |
| 420434 | 4/1947 | Italy | 52/593 |
| 591067 | 8/1947 | United Kingdom | 52/286 |

*Primary Examiner*—James L. Ridgill, Jr.

*Attorney, Agent, or Firm*—Harvey B. Jacobson .

[57] ABSTRACT

A building block, of generally the same overall shape as a concrete or cinder block, is provided and includes upper and lower recesses and projections which interlock the blocks in tiers of blocks for compact storage and shipment and which enable the blocks of adjacent courses of blocks to be interlocked with each other during construction of a wall. In addition, the blocks include reinforcing members embedded therein for transferring vertical loads through vertically stacked courses of blocks and some forms of reinforcing enable cementitious material poured into the cavities of the block to be reinforced. One form of reinforcing is tubular and includes bell and spigot ends which may be sealingly engaged with each other and used to allow heating or cooling fluids to flow through the blocks.

15 Claims, 20 Drawing Figures

Fig. 16
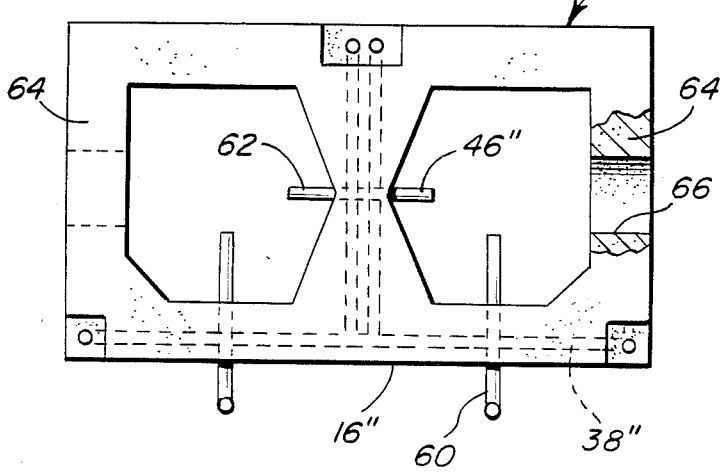
Fig. 17
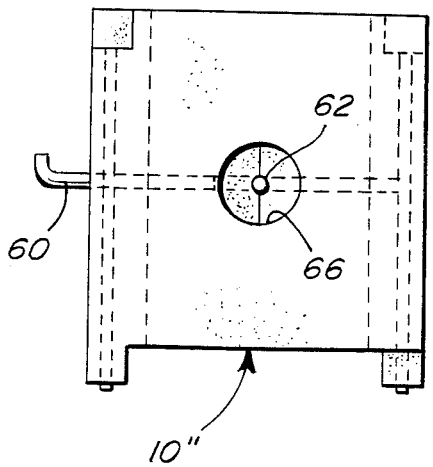
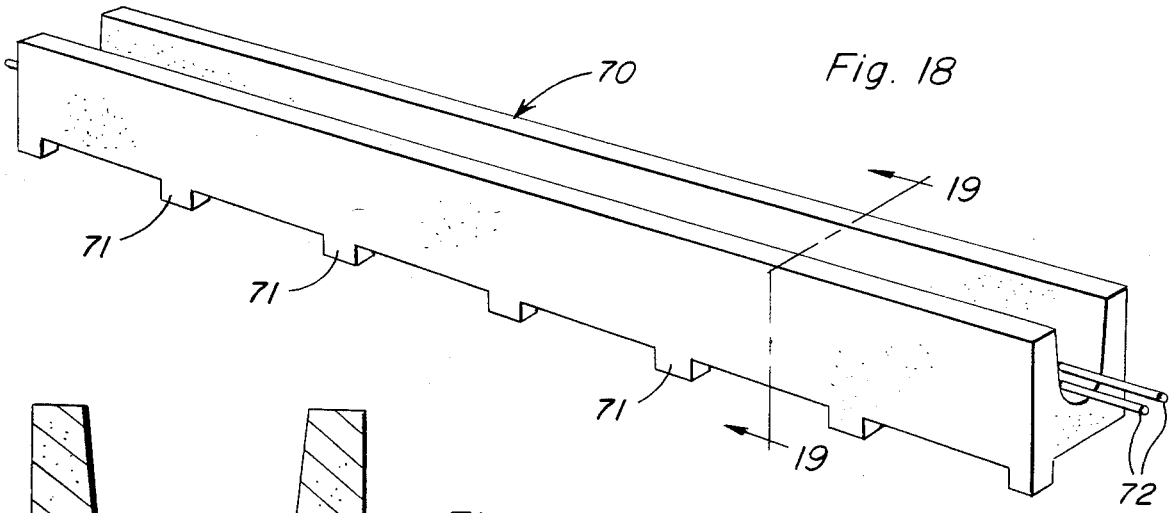
Fig. 18
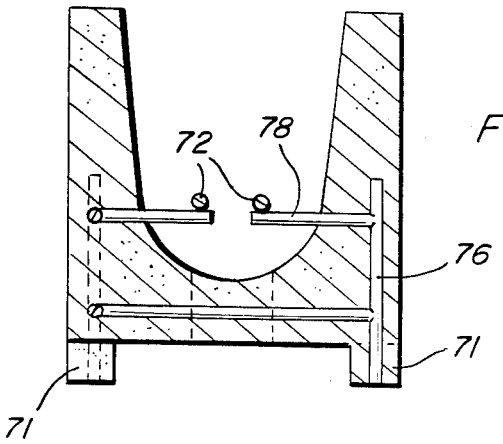
Fig. 19
Fig. 20
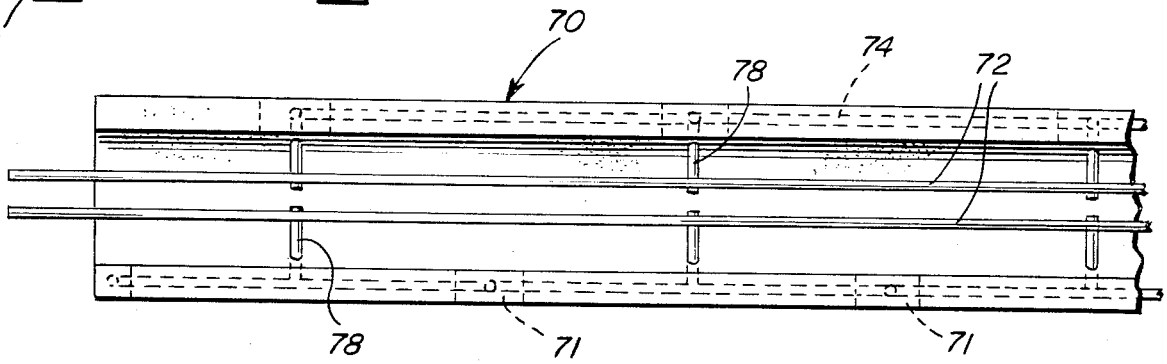

BUILDING BLOCK WITH REINFORCEMENT AND/OR POSITIONING LUGS AND RECESSES

BACKGROUND OF THE INVENTION

Various forms of building blocks heretofore have been provided with interlocking projections and recesses. However, most of these previously known forms of building blocks include mating projections and recesses which may be used to interlock only adjacent staggered courses of blocks and which are not operative to interlock stacked tiers of blocks while a quantity thereof are being stored or shipped in a compact state.

Examples of various different forms of building blocks including some of the general structural and operational features of this instant invention are disclosed in U.S. Pat. Nos. 86,961, 253,416, 779,613, 1,833,875, 2,062,851, 2,474,186 and 3,382,632.

BRIEF DESCRIPTION OF THE INVENTION

The building block of the instant invention includes projections and recesses which enable longitudinally staggered adjacent courses of blocks to be interlockingly engaged with each other and yet which further allow vertical tiers of stacked blocks to be interlocking engaged relative to each other for compact storage and shipment.

The building block additionally is constructed in a manner including internal reinforcing whereby vertical loads may be transferred directly through the vertical reinforcing in a wall of stacked staggered courses of blocks and the reinforcing may also be tubular whereby heating and cooling fluids may be circulated through a wall constructed of the blocks. Further, some forms of block reinforcing may also be utilized to reinforce cementitious filler material poured into the block cavities and the interfitting projections and recesses of the blocks may be dimensioned to provide a desired thickness layer mortar between adjacent block surfaces.

The main object of this invention is to provide a universally usable building block which may be compactly stored and shipped with vertically adjacent blocks interlockingly engaged with each other and yet which may be erected in a wall of longitudinally staggered adjacent courses of blocks in a manner such that the blocks of adjacent courses are interlocked with each other.

Another object of this invention is to provide an improved building block construction including internal reinforcing.

A further object of this invention, in accordance with the immediately preceding object, is to provide a building block including internal reinforcing which may function to transfer vertical loads placed upon a wall of the blocks directly therethrough by the internal block reinforcing.

Still another object of this invention is to provide a building block including internal reinforcing which may be used to define heating or cooling fluent passages formed in a wall constructed of the blocks.

A further important object of this invention is to provide a building block and a companion header block constructed in a manner whereby the header block and building block may be interfittingly engaged with each other.

A still further object of this invention is to provide a building block whose coacting projections and recesses may be dimensioned to define mortar joints between opposing surfaces of adjacent blocks to be of a predetermined thickness.

A final object of this invention to be specifically enumerated herein is to provide an improved building block in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 16 is a top plan view of a modified form of building block including internal reinforcing which may also serve to reinforce cementitious filler placed in the block cavities and further including block end openings through which cementitious filler in end adjacent blocks may bridge between the interiors of the attendant adjacent blocks;

FIG. 17 is a right side elevational view of the block illustrated in FIG. 16;

FIG. 18 is a respective view of a header or lintel block which may be used in conjunction with the blocks illustrated in FIGS. 1–17;

FIG. 19 is an enlarged transverse vertical sectional view taken substantially upon the plane indicated by the section line 19—19 in FIG. 18; and FIG. 20 is a fragmentary enlarged top plan view of the lintel block illustrated in FIGS. 18 and 19.

DETAILED DESCRIPTION OF THE INVENTION

Figure 1:
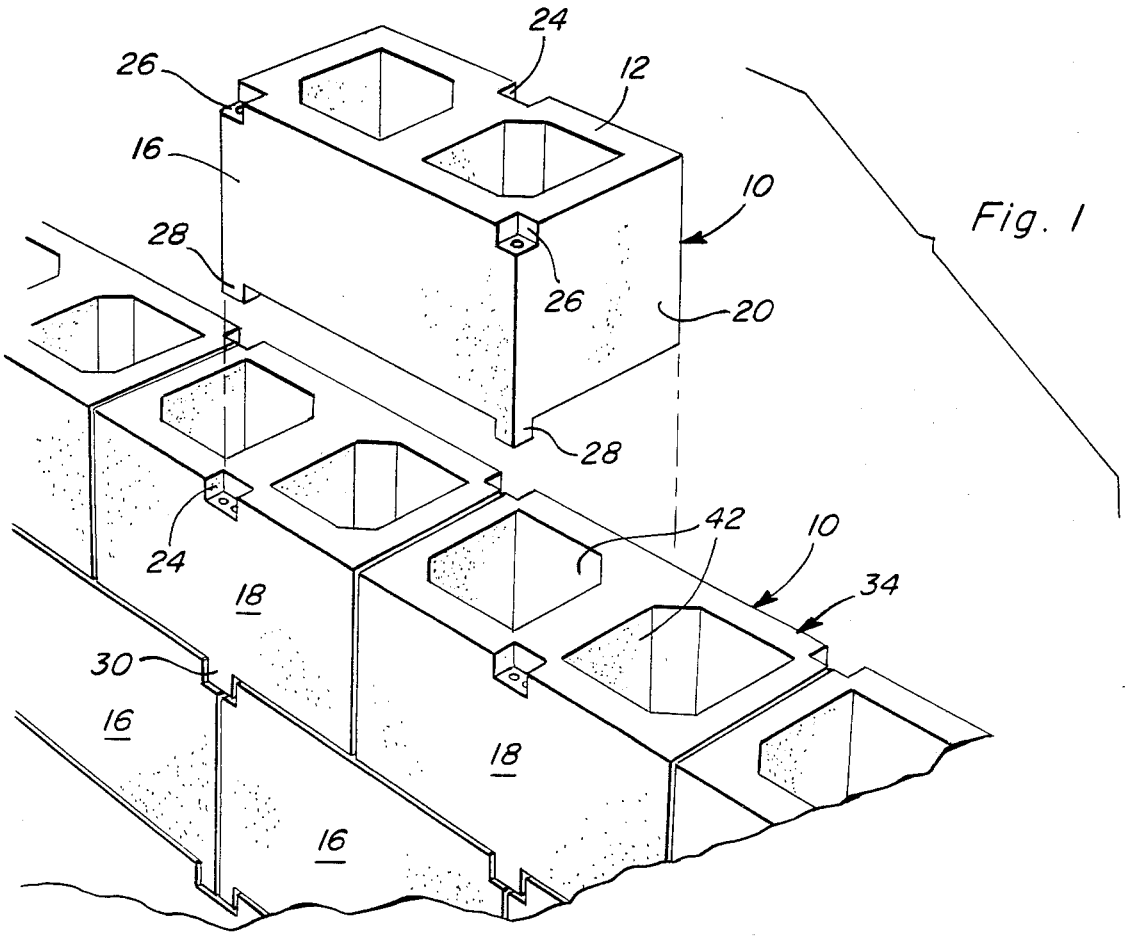
FIG. 1 is a fragmentary perspective view of a wall construction utilizing interfittingly engageable blocks constructed in accordance with the present invention.
Figure 2:
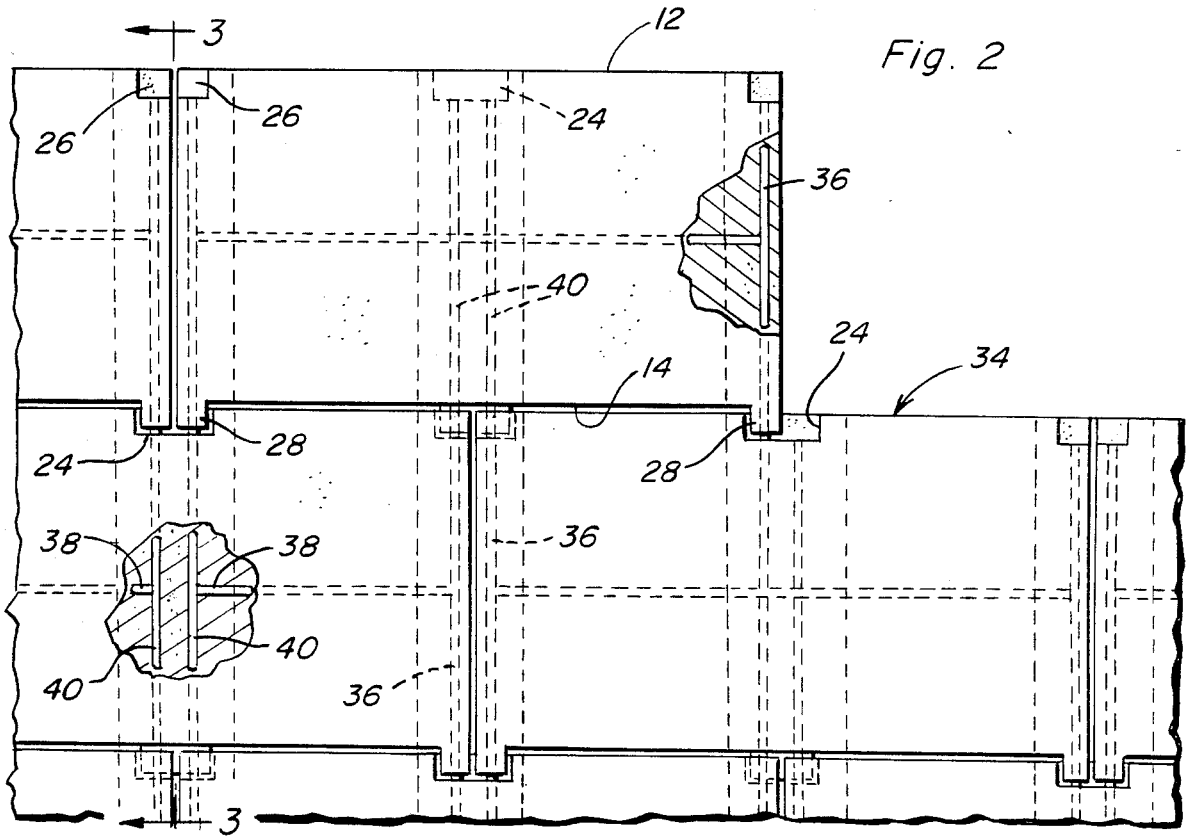
FIG. 2 is a fragmentary enlarged elevational view of the wall illustrated in FIG. 1 with portions of two of the blocks of the wall being broken away and illustrated in vertical section.
Figure 3:
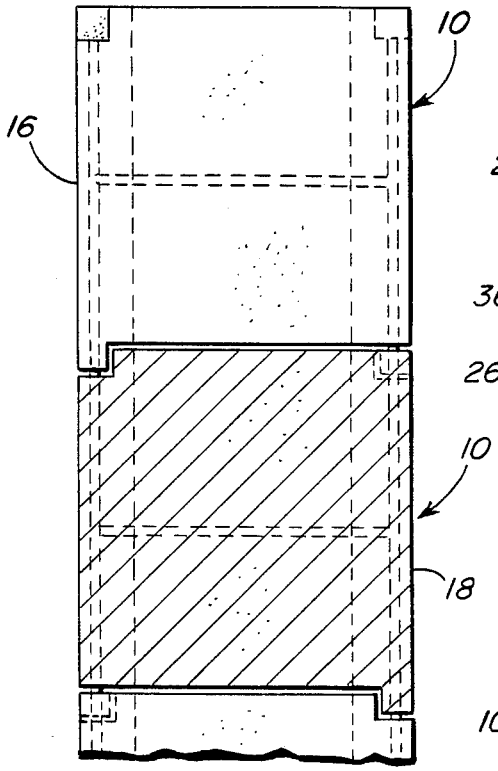
FIG. 3 is a fragmentary vertical sectional view taken substantially upon the plane indicated by the section line 3—3 of FIG. 2.
Figure 4:
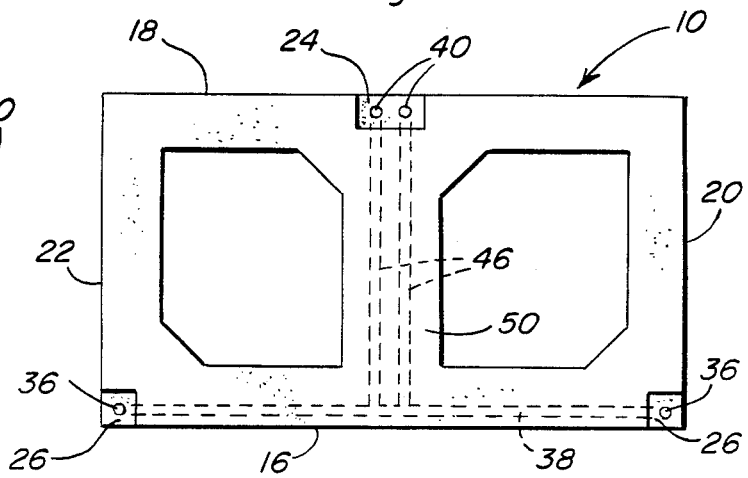
FIG. 4 is an enlarged top plan view of a block constructed in accordance with the present invention.

Referring now more specifically to FIGS. 1–5 of the drawings, there may be seen a building block referred to in general by the reference numeral 10. The building block 10 may be formed as a cinder block or as a concrete block, or the block 10 may be constructed of other materials including glass and plastic. The block 10 includes top and bottom faces 12 and 14, front and rear surfaces 16 and 18 and opposite end surfaces 20 and 22. The top and bottom faces are generally parallel as are the front and rear surfaces 16 and 18 and the opposite end surfaces 20 and 22. The central portion of the rear marginal edge of the top face 12 includes an upwardly opening recess 24 formed therein which also opens rearwardly through the rear surface 18 and the opposite ends of the front marginal edge of the top face 12 includes a pair of corner recesses 26 formed therein which also open horizontally outwardly of the front face 16 and the opposite end surfaces 20 and 22.

It will also be noted that the forward marginal portion of the bottom face 14 includes opposite end downward corner projections 28 and that the central portion of the rear surface 18 includes a downward central section 30.

When a plurality of blocks 10 are stacked in vertically registered positions with the front surfaces 16 thereof facing in the same direction, the downward corner and central projections 28 and 30 of each upper block 10 are received in the recesses 26 and 14, respectively, of the next lower block 10. In this manner, vertically stacked blocks 10 are keyed together for compact storage and shipment in the manner illustrated in FIG. 5 of the drawings. However, when the blocks 10 are to be used in the construction of a wall such as the wall referred to in general by the reference numeral 34 in FIG. 1, the blocks 10 in adjacent horizontal courses of blocks 10 are reversed front to rear relative to each other.

At this point, it is pointed out that the recesses 24 are of substantially twice the plan area of the recesses 26 and, accordingly, while the corner projections 28 and projections 30 are received in the recesses 26 and 24 when the blocks 10 are vertically stacked in full registered positions, when the blocks 10 of vertically adjacent courses of blocks are reversed front to rear relative to each other and relatively staggered in the manner illustrated in FIG. 1 of the drawings, each corner projection 28 of an upper block is received in one-half of the recesses 24 of adjacent blocks disposed therebelow and each projection 30 is received in the pair of corner recesses 26 disposed therebelow. In this manner, the blocks 10 of vertically adjacent courses of blocks may also be interfitted relative to each other when the blocks of vertically adjacent courses of longitudinally staggered blocks are reversed relative to each other in front to rear relation.

With attention again invited to FIGS. 1–5 and more particularly to FIGS. 2, 3 and 4, each front corner portion of each block 10 includes a vertically extending reinforcing member 36 embedded therein and extending vertically therethrough with the upper end of each reinforcing member 36 being generally centered in the corresponding recess 26 and terminating upwardly flush with the bottom of the corresponding recess 26. The lower ends of the reinforcing members 36 may extend, for example, approximately 1/16 of an inch below the lower extremity of the corresponding corner projection 28 so that a small mortar space of substantially 1/16 of an inch will be defined between the top face 12 of a lower block 10 and the bottom face 14 of an upper block 10. Also, the extent of the projections 28 lengthwise of the blocks 10 is slightly less than one-half the extent of the recesses 24 longitudinally of the blocks 10, whereby the spacing between end opposing blocks 10 will also be approximately 1/16 of an inch. In this manner, a very thin mortar joint may be used.

If it is desired, however, the lower ends of the reinforcing members 36 may terminate flush with the lower ends of the corner projections 28.

The vertical midportions of the reinforcing members 36 are joined by a forward mid-heihgt reinforcing member 38 extending and secured therebetween and the rear longitudinal midportion of the block 10 includes a pair of slightly laterally spaced apart reinforcing members 40. The reinforcing members 40 terminate upwardly flush with the lower extremities of the recesses 24 and the lower ends of the reinforcing members 40 may project downwardly below the lower ends of the projections 30 by approximately 1/16 of an inch. Accordingly, the 1/16 inch mortar joint between all opposing surfaces of adjacent blocks is maintained.

Figure 6:
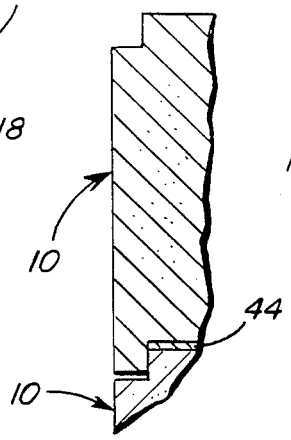
FIGS. 6, 7 and 8 comprise fragmentary vertical sectional views of blocks including projections of slightly different configurations.
Figure 7:
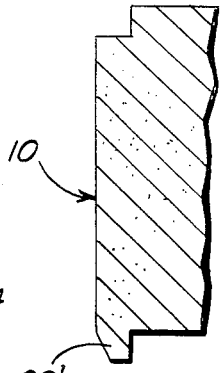
Figure 8:
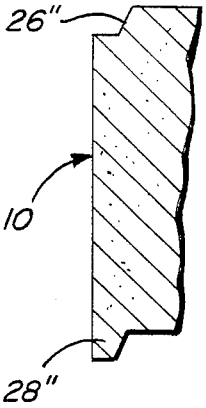
Figure 5:
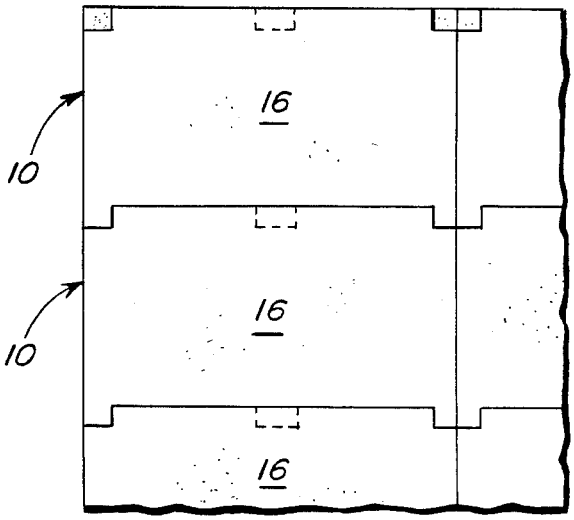
FIG. 5 is a fragmentary elevational view illustrating the manner in which tiers of vertically spaced blocks constructed in accordance with the present invention may be interlockingly engaged with each other.

Blocks 10 may have a pair of vertically extending openings or voids 42 formed therein and if it is desired, vertically adjacent blocks 10 may be separated by thin mortar joints 44 which do not include portions thereof disposed between the lower ends of the projections 28 and 30 and the lower extremities of the recesses 24 and 26, see FIG. 6. In addition, the projections 28 as well as th projections 30 may be bevelled in the manner indicated as at 28′ in FIG. 8 or otherwise bevelled in the manner indicated by the reference numeral 28″ in FIG. 8. Still further, FIG. 8 also illustrates the manner in which the recesses 26 and 24 may be bevelled as indicated at 26″ in FIG. 8.

The reinforcing members 40 of the block 10 are connected to the central portion of the reinforcing member 38 by front to rear extending reinforcing members 46 extending and secured between the reinforcing members 40 and the reinforcing member 38 and in this manner the central web 50 of the block 10 as well as the front wall thereof is adequately reinforced.

Figure 9:
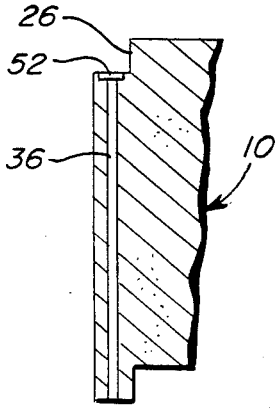
FIGS. 9 and 10 are fragmentary vertical sectional view illustrating different forms of upper bearing plate equipped vertical reinforcing rods which may be used in the block.

As may be seen from FIG. 9, the upper ends of each vertical reinforcing member 36 may be provided with a plate 52 secured thereto in any convenient manner such as welding and recessed within that portion of block 10 defining the lower extremity of the corresponding recess 26. In addition, the upper ends of the reinforcing rods 40 may be equipped with similar plates.

Figure 10:
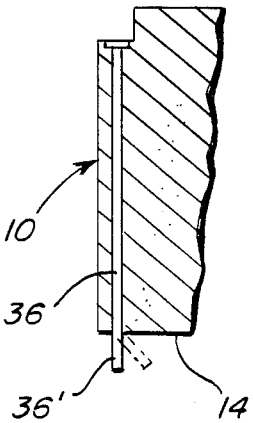
Figure 11:
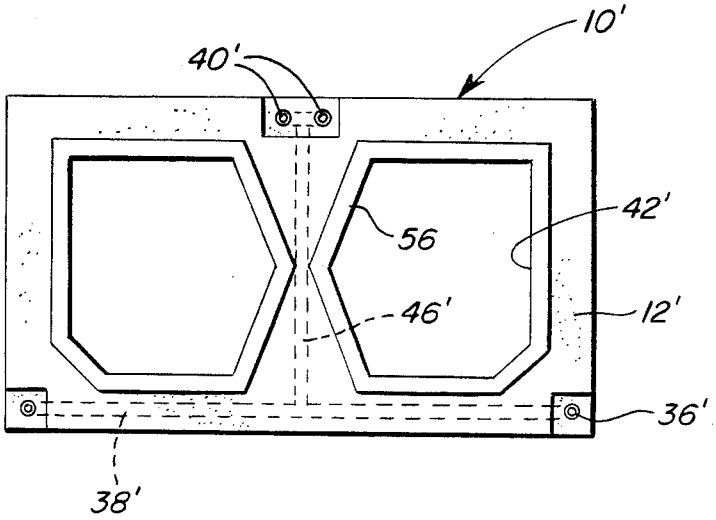
FIG. 11 is a top plan view of a modified form of building block including cavity seals for sealing cavities between adjacent courses of blocks and wherein the internal reinforcing of the block may comprising tubular members.
Figure 13:
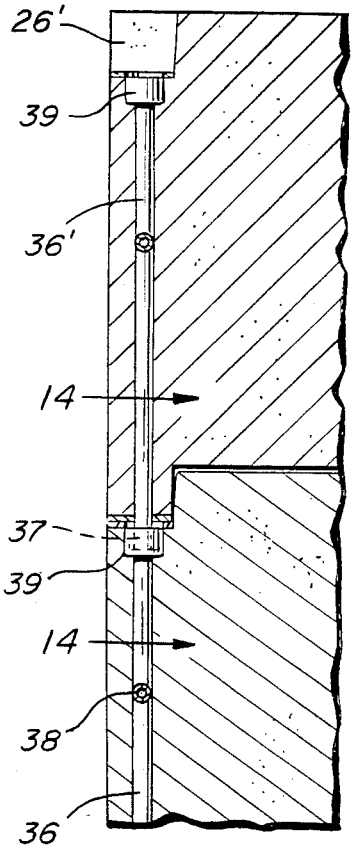
FIG. 13 is a fragmentary enlarged vertical sectional view illustrating the mann in which blocks inclusive of the structure illustrated in FIGS. 10 and 12 may be interfitted relative to each other.
Figure 12:
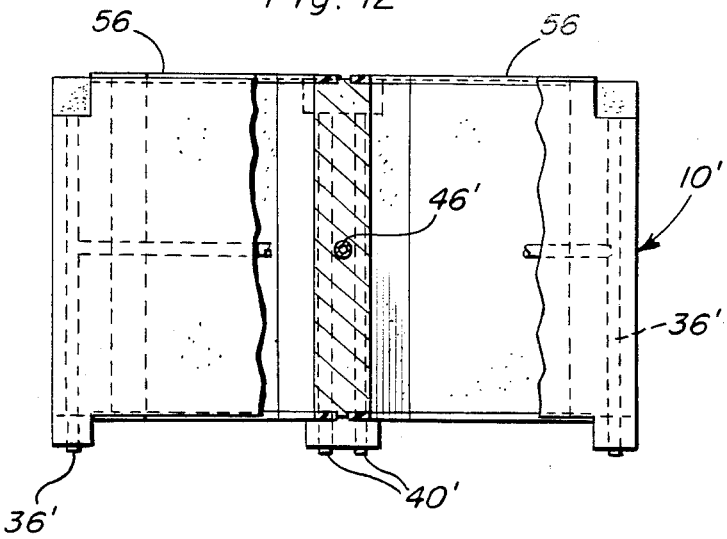
FIG. 12 is an elevational view of the block illustrated in FIG. 11 with portions thereof being broken away and illustrated in vertical section.
Figure 14:
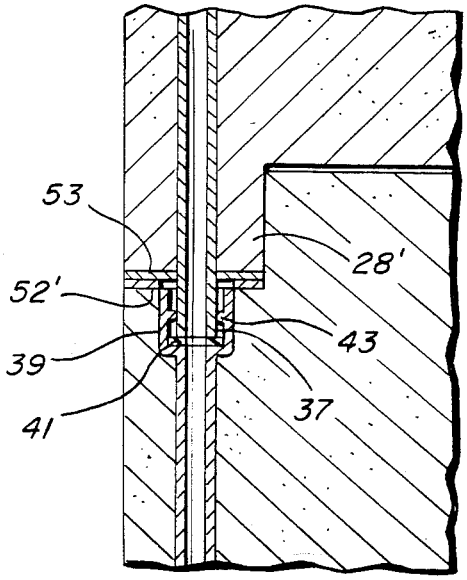
FIG. 14 is an enlarged vertical sectional view taken substantially upon the plane indicated by the section line 14—14 of FIG. 13.
Figure 15:
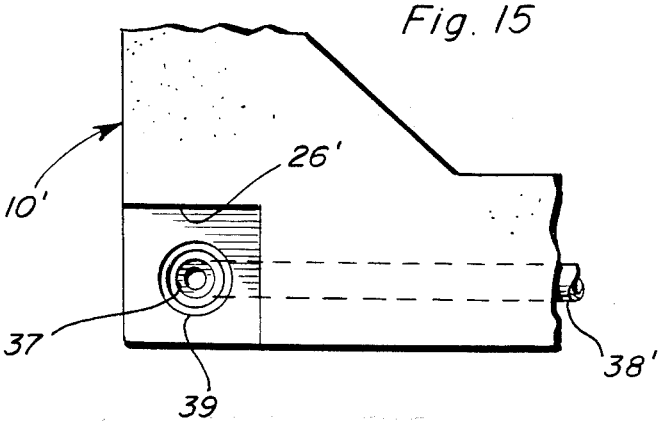
FIG. 15 is a fragmentary top plan view of the corner portion of the lower block illustrated in FIG. 14 and with the face seal illustrated in FIGS. 11 and 12 removed.

A further modification of the block 10 is illustrated in FIG. 10 of the drawings in which the lower end of the reinforcing member 36 projects downwardly below the bottom face 14 and is not embedded within a projection such as the projection 28. Rather, the lower terminal end 36′ of the reinforcing member 36 which projects below the bottom face 14 may be weakened by any suitable means at the plane of the bottom face 14 in order that the lower terminal end 36' may be laterally deflected and broken from the remaining upper portion of the reinforcing member 36, if desired.

With attention now invited more specifically to FIGS. 11 through 15 of the drawings, a modified form of building block is referred to in general by the reference numeral 10'. The block 10' is substantially identical to the block 10, except that the vertical openings or voids 42' formed therein are of a slightly different shape and the top face 12' of the block 10' includes open frame resilient seals 56 supported therefrom whereby the upper and lower ends of the openings or voids 42 of adjacent blocks may be sealed relative to each other. In addition, instead of utilizing solid reinforcing members which is the reinforcing members 36, 38, 40 and 46, the block 10' includes tubular reinforcing members 36', 38', 40' and 46' which are communicated with each other. The upper ends of the tubular reinforcing members 36' include bell ends 49 which open upwardly into the corresponding recess 26' corresponding to the recesses 26 and the lower ends of the tubular reinforcing members 36' define spigot ends 37 which are downwardly receivable in a fluid tight manner within the bell ends, see FIG. 4 wherein it may be seen that the bell ends are provided with sealing washers 41 for engagement with the opposing spigot ends and the bell ends 39 further include mid-height circumferentially extending ribs 43 for tightly frictionally engaging the corresponding spigot ends 37. The bell ends 39 may open upwardly through plates 52' corresponding to the plates 52 and the spigot ends 38 may open downwardly through plates 53 carried thereby and abutted against the lower ends of the projections 28' corresponding to the projections 28. Of course, the upper and lower ends of the tubular reinforcing members 40' are formed in the same manner.

With attention invited more speifically to FIGS. 16 and 17 of the drawings, there will be seen a third form of building block referred to in general by the reference numeral 10''. The building block 10'' includes projections and recesses corresponding to the projections 28, 30 and recesses 24, 26 and reinforcing members 38'' and 46'' corresponding to the reinforcing members 38 and 46. However, the reinforcing members 38'' include front to rear extending cross pieces 60 projecting forwardly through the front surface 16'' in the form of upwardly opening hooks and projecting horizontally rearwardly through the front wall of the block 10'' and terminating rearwardly adjacent the centers of the corresponding vertically extending block openings or cavities. In this manner, the openings or cavities may be filled with cementitious material or the like and such cementitious material may be reinforced by the rearwardly projecting portions of the cross pieces 60. In addition, the reinforcing members 46'' include a cross piece 62 extending longitudinally of the block 10'' and which project into the vertically extending openings or cavities of the block 10' and whose opposite ends may also be embedded in cementitious material used to fill the openings or voids. Further, the end walls 64 of the block 10'' may have mid-height openings 66 formed therethrough whose inner ends open into the corresponding vertical openings or cavities and which thereby enable a cylindrical rod of cementitious material to connect cementitious filler portions disposed in the vertical openings or cavities in adjacent block ends.

With attention now invited more specifically to FIGS. 18, 19 and 20, an upper lintel block or header is referred to in general by the reference numeral 70. The header 70 is in the form of an upwardly opening U-shaped channel member and opposite longitudinal sides of the undersurface of the lintel block 70 include longitudinally staggered downward projections 71 which are receivable in the recesses 24 and 26 of blocks disposed immediately therebeneath. The lintel block 70 includes central longitudinally extending reinforcing members 72 which may be embedded in cementitious material used to fill the interiors of the channel-shaped lintel blocks 70 and the latter additionally include opposite side longitudinally extending reinforcing members 74 extending between adjacent upright reinforcing members 76 which project upwardly through the projections 71 and have lateral integral arm portions 78 from which the corresponding reinforcing members 72 are supported. Accordingly, it may be seen that the lintel block 70 may be supported atop the uppermost course of blocks 10. Also, it is to be noted that the lower ends of the reinforcing members 76 may project slightly below the lower ends of the corresponding projections 71.

When the tubular reinforcing members illustrated in FIGS. 10–15 are used, heating or cooling liquids may be circulated through these tubular reinforcing members, as desired, to heat or cool the associated wall. It is also to be noted that the various vertical reinforcing members act to transfer a vertical loading on the upper portion of the wall 34 directly downwardly therethrough to the footing of the wall. In this manner, the wall 34 includes considerably greater load bearing capacity than a similar wall constructed without the utilization of vertically extending reinforcing members embedded in the individual blocks of the wall.

The amount the vertical reinforcing members project downwardly from corresponding projections determines the vertical thickness of the mortar joints between adjacent horizontal courses of blocks 10. In addition, the longitudinal extent of the projections 28 longitudinally of the blocks 10 determines the mortar joint spacing between adjacent block ends.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A plurality of building blocks for compact interfitted stacking in vertically aligned relation during storage and transport and also for interfitted engagement between adjacent courses of blocks when forming a wall incorporating lengthwise staggered adjacent courses of blocks, each of said blocks including rectangular top and bottom parallel faces, parallel front and rear side surfaces and opposite end surfaces, said bottom and top faces including coacting outwardly projecting and opening projections and recesses, respectively, said top face recesses in each of said blocks including a single central recess opening upwardly through the longitudinal mid-portion of the longitudinal edge of the block top face adjoining one side surface of said block and also opening horizontally outwardly of the longitudinally mid-portion of the upper marginal edge of said one side surface and a single pair of end recesses opening upwardly through the terminal end portions of the longitudinal edge of said top face adjoining the other side surface of said block and also opening horizontally outwardly of the adjacent terminal ends of the upper edges of the corresponding side and end surfaces of said blocks, said bottom face projections, on each block, including a single central projection projecting downwardly from the longitudinal mid-portion of the longitudinal edge of the bottom face adjoining said one side surface of said block and a single pair of end projections projecting downwardly from the terminal end portions of the longitudinal edge of said bottom face adjoining the other side surface of said block, said recesses and projections of said blocks being positioned for interfitting engagement with the projections and recesses of vertical adjacent blocks when said blocks are vertically stacked in substantially full vertically registered positions and said front surfaces of said blocks face in the same direction and also for interfitting engagement with the projections and recesses of adjacent blocks when said blocks are disposed in a horizontal course of blocks vertically sandwiched between stacked courses of similar end aligned blocks and adjacent courses of blocks are lengthwise staggered relative to each other and the front surfaces of the blocks of adjacent courses face in opposite directions.

2. The building block of claim 1 wherein the extent of those longitudinal midportion block recesses and projections extending longitudinally of said blocks is slightly greater than twice the extent of those block end recesses and projections extending longitudinally of said blocks.

3. The building blocks of claim 1 wherein each block includes a plurality of vertical openings formed therethrough and at least one of said faces includes seal means extending about each of said openings.

4. The building blocks of claim 1 including a lintel block of more than twice the length of each building block, said lintel block being generally U-shaped in transverse cross section and including internal reinforcing, said block including an undersurface downwardly from which opposite side longitudinally staggered projections extend, said lintel block being positionable over a course of a plurality of end aligned building blocks with the projections of said lintel block downwardly received in the recesses of said course of building blocks.

5. The building blocks of claim 1 wherein each building block includes longitudinally spaced vertical openings formed therethrough defining end walls extending between remote side surfaces of said block, said end walls having midheight openings formed therethrough.

6. The building blocks of claim 5 wherein each building blocks includes internal reinforcing and portions of said internal reinforcing project into said openings.

7. The building blocks of claim 6 wherein other portions of said internal reinforcing project through and outwardly beyond one of said front and rear surfaces and define hook portions.

8. A plurality of building blocks for compact interfitted stacking during storage and transport and also for interfitted engagement when erected in a wall construction with the blocks of vertically adjacent courses of blocks staggered lengthwise relative to each other, said blocks being substantially parallelopiped in shape and including generally horizontal top and bottom faces, parallel opposite side surfaces and end surfaces extending between corresponding ends of said faces and side surfaces, said blocks each including a single pair, only, of opposite end first corner recesses formed therein opening outwardly through one of said faces at the corner junctures thereof with the corresponding end surfaces and one of said side surfaces and also opening outwardly through said one side and end surfaces, said blocks each also including a single pair, only, of first corner projections projecting outwardly from the corner portions of said other face corresponding to said corner portions of said one face and snugly receivable in recesses corresponding to the first mentioned recesses formed in an adjacent block with which the first mentioned block is vertically superposed, the longitudinal midportion of one longitudinal margin of each of said one faces including a single second recess formed therein opening outwardly through said one face and the other of said side surfaces, the longitudinal midportion of said other face of each block including a single projection projecting outwardly therefrom adjacent said other side surfaces, said second projections being receivable in said second recess formed in an adjacent superposed block, said second recess and projection extending longitudinally of each block an extent equal to at least twice the longitudinal extent of said first projections and recesses longitudinally of said blocks, whereby opposing first projections at adjacent ends of a pair of aligned blocks staggered relative to a lower block disposed therebeneath may be received in the second recess of said lower block and said second projection of each upper block may be received in opposing corner recesses of a pair of end aligned lower blocks.

9. The building blocks of claim 8 wherein the lower ends of said vertical reinforcing members project slightly endwise outwardly from said projections, the outwardly projecting ends of said reinforcing members being weakened whereby they may be broken from the upper portions of said reinforcing members.

10. The building blocks of claim 8 wherein one of the inner and outer surfaces of said projections are bevelled.

11. The building blocks of claim 8 wherein each block includes vertical reinforcing members extending between corresponding corner recesses and projections and between said second recess and projection.

12. The building blocks of claim 11 wherein said vertical reinforcing members project slightly endwise outwardly from the corresponding projections.

13. The building blocks of claim 12 wherein the ends of said projections opening into said recesses include transverse bearing plates anchored relative thereto and recessed in the bottom surfaces of said recesses for engagement by the outwardly projecting ends of vertical reinforcing members disposed thereabove.

14. The building blocks of claim 11 wherein said vertically reinforcing members comprise rod-like members.

15. The building blocks of claim 11 wherein said vertically reinforcing members comprise tubular members and the upper ends of said tubular members include bell ends and the lower ends of tubular members project slightly outwardly from said projections and define spigot ends telescopically engageable with said bell ends.

* * * * *